US008585305B2

(12) United States Patent
Naito

(10) Patent No.: US 8,585,305 B2
(45) Date of Patent: Nov. 19, 2013

(54) PRINTER

(75) Inventor: Akio Naito, Chiba (JP)

(73) Assignee: Seiko Instruments Inc. (JP)

( * ) Notice: Subject to any disclaimer, the term of this patent is extended or adjusted under 35 U.S.C. 154(b) by 355 days.

(21) Appl. No.: 12/930,938

(22) Filed: Jan. 20, 2011

(65) Prior Publication Data

US 2011/0188917 A1 Aug. 4, 2011

(30) Foreign Application Priority Data

Feb. 2, 2010 (JP) ..... 2010-012537

(51) Int. Cl.
*B41J 29/02* (2006.01)

(52) U.S. Cl.
USPC ..... 400/693; 400/663; 347/197; 347/220; 347/222

(58) Field of Classification Search
USPC ..... 400/693
See application file for complete search history.

(56) References Cited

U.S. PATENT DOCUMENTS

| | | | | |
|---|---|---|---|---|
| 4,602,877 | A * | 7/1986 | Fushimoto | 400/693 |
| 4,802,795 | A * | 2/1989 | Takada | 400/692 |
| 7,165,903 | B2 * | 1/2007 | Naito | 400/693 |
| 2003/0118390 | A1 | 6/2003 | Yamada et al. | 400/703 |
| 2003/0160857 | A1 * | 8/2003 | Seino et al. | 347/171 |
| 2010/0143018 | A1 * | 6/2010 | Kawaguchi | 400/621 |
| 2011/0170904 | A1 * | 7/2011 | Sudo et al. | 399/110 |
| 2011/0203467 | A1 * | 8/2011 | Naito | 101/212 |

FOREIGN PATENT DOCUMENTS

| | | |
|---|---|---|
| EP | 1338425 | 8/2003 |
| EP | 1702759 | 9/2006 |
| EP | 1749671 | 2/2007 |

* cited by examiner

*Primary Examiner* — Jill Culler
(74) *Attorney, Agent, or Firm* — Adams & Wilks

(57) ABSTRACT

A printer includes a rocking member with a rotary shaft and a bearing portion for axially supporting a platen roller, and a latch member having a protrusion. The latch member is rotatably connected to the rotary shaft portion of the rocking member so as to be rotatable about a rotary axis that is non-coaxial with and parallel to a platen axis. The rotary shaft portion of the rocking member projects along the rotary axis from an inner side surface of the rocking member. A stationary frame supports a recording head and includes a first recess into which the bearing portion of the rocking member is disengageably fitted and a second recess into which the protrusion of the latch member is disengageably fitted after the bearing portion is fitted in the first recess.

19 Claims, 10 Drawing Sheets

PRINTER

BACKGROUND OF THE INVENTION

1. Field of the Invention

The present invention relates to a printer in which a platen roller and a recording head are separably combined with each other.

2. Description of the Related Art

As conventionally known printers, there are given printers in which a recording head and a platen roller held in contact with the recording head are provided inside a casing, and in which the recording head performs recording onto a recording sheet sent out by the platen roller. In the printers of this type, for example, at the time of setting of the recording sheet or jam treatment, or at the time of maintenance or replacement of the recording head, the platen roller, and the like, the recording head and the platen roller remain in contact with each other inside the casing. Thus, workability is poor.

In view of this, it is desired that the recording head and the platen roller be spaced apart from each other so as to be exposed to an outside of the casing. In particular, the recording head includes a plurality of recording elements (heat-generating elements or the like), and hence it is preferred that the recording head be fixed on a casing side in order not to impair reliability of electrical connections into which recording signals for selectively driving the recording elements are input. In other words, it is desired that the platen roller be spaced apart from the recording head so as to be exposed to the outside, with the recording head being fixed on the casing side.

For satisfaction current demands, there have been provided some printers in which the platen roller is freely attachable and detachable and, at the time of attachment, the platen roller is retained under a state of being held in contact with the recording head at a predetermined pressure.

As one of the printers, there has been known a printer which includes a regulating member and a stationary frame, in which a platen roller can be easily attached and detached with use of those members, and in which the platen roller can be retained with high reliability while the platen roller is prevented from being inadvertently disengaged at the time of mounting (refer to JP 4376816B).

The regulating member includes a connecting portion into which a shaft portion of the platen roller is fitted, and the regulating member is undisengageably combined with the platen roller through intermediation of the connecting portion. Meanwhile, the regulating member is rotatably combined coaxially with and relatively to the platen roller. Note that, regarding movement except the relative rotation, the regulating member moves integrally with the platen roller. Further, the regulating member is provided with a protrusion-like engagement portion.

Meanwhile, the stationary frame is fixed to abase of a casing, and includes a first recess and a second recess. The first recess is a recess for positioning the platen roller to a recordable position by bringing the platen roller into contact with the recording head when the shaft portion of the platen roller is inserted. The second recess is a recess for retaining a protrusion of the stationary frame when the protrusion is inserted under a state in which the shaft portion of the platen roller is inserted in the first recess.

When the platen roller is attached in the printer structured as described above, the shaft portion of the platen roller is inserted in the first recess and retained therein, and then the regulating member is rotated relatively to the platen roller and the protrusion is inserted into the second recess and retained therein. With this, at the recordable position at which the platen roller is held in contact with the recording head, the platen roller can be reliably retained.

In particular, due to a positional relation, shapes, and the like of the first recess and the second recess, even with application of an external force, for example, the platen roller is prevented from being disengaged from the first recess, and the platen roller and the protrusion are prevented from being disengaged respectively from the first recess and the second recess. In other words, the printer is designed so that the platen roller is less liable to be inadvertently disengaged. Thus, the platen roller can be retained with high reliability.

Meanwhile, when the platen roller is detached, the regulating member is rotated relatively to the platen roller (rotated in a direction reverse to that in the above-mentioned case). Consequently, the protrusion is disengaged from the second recess, and then the shaft portion of the platen roller is disengaged from the first recess. In this manner, the platen roller can be detached.

As described above, the platen roller can be attached and detached with a simple manipulation of rotating the regulating member so that the protrusion is inserted into or disengaged from the second recess. Thus, the printer is excellent in manipulation properties of attachment and detachment.

By the way, as well as for various electronic apparatuses, further downsizing of printers will be required also in the future. Thus, it is desired that the printers be structured as simply as possible and components be designed to be small. In particular, the platen roller for feeding the recording sheet is larger among the components of the printers, and hence occupies a large space in the printer. Thus, downsizing of the printer is efficiently achieved through possible reduction of a diameter of the platen roller.

In this regard, in the above-mentioned conventional printer, it is structurally difficult to reduce the diameter of the platen roller, and hence there has been a room for improvement . Specifically, the connecting portion of the regulating member is coaxially fitted into the shaft portion of the platen roller. Accordingly, when the diameter of the platen roller is reduced, it is necessary to reduce an outer diameter of the connecting portion in accordance therewith. However, in order to reliably fit the connecting portion into the shaft portion without backlash or the like, it is structurally necessary to secure a certain outer diameter. Accordingly, it is practically difficult to further reduce the diameter of the platen roller at present.

SUMMARY OF THE INVENTION

The present invention has been made in view of such circumstances. It is therefore an object of the present invention to provide a printer in which the attachment and detachment manipulation of the platen roller can be easily performed, in which the platen roller can be retained with high reliability at the time of attachment, and in which downsizing of the entire printer is easily achieved due to use of the platen roller smaller in diameter.

The present invention provides the following measures for achieving the above-mentioned object.

(1) According to the present invention, provided is a printer in which a recording head and a platen roller are separably combined with each other. The printer includes: a rocking member which includes a bearing portion for axially supporting the platen roller, and is fixed to a platen frame so as to be rockable under a state of axially supporting the platen roller; a latch member which is coupled to the rocking member under a state of being rotatable about a rotary axis that is non-coaxial with and parallel to a platen axis of the platen roller; a protrusion which is provided to the latch member and rotationally moves about the rotary axis in accordance with rotation of the latch member; and a stationary frame to which the recording head is fixed, in which: the stationary frame includes a first recess into which the bearing portion is disengageably fitted, the first recess retaining the platen roller at a position of facing the recording head, and a second recess into which, after the bearing portion is fitted into the first recess, the protrusion is disengageably fitted due to the rotation of the latch member; and the bearing portion is undisengageable from inside the first recess while the protrusion is fitted in the second recess, and is disengageable from inside the first recess after the protrusion is disengaged from inside the second recess.

According to the printer of the present invention, the attachment and detachment manipulation of the platen roller can be easily performed, and hence the platen roller and the recording head can be quickly combined with each other or quickly separated and disengaged from each other.

First, when the platen roller is attached, the bearing portion provided to the rocking member for the purpose of axially supporting the platen roller is inserted and fitted into the first recess of the stationary frame. In this case, the rocking member is fixed to the platen frame so as to be rockable, and hence the bearing portion can be smoothly fitted into the first recess. As a result of fitting of the bearing portion into the first recess, the platen roller can be retained at the position of facing the recording head, and a printable state can be set.

Next, the latch member coupled to the rocking member is rotated about the rotary axis, and the protrusion is inserted and fitted into the second recess. With this, the attachment of the platen roller is completed, and the bearing portion is undisengageable from inside the first recess.

In particular, even when an external force is applied to the platen roller from the recording head, the recording sheet, and the like, the bearing portion is prevented from being disengaged from inside the first recess. Thus, the platen roller can be retained with high reliability at the time of attachment. Note that, the protrusion is less liable to be subjected to the external force in comparison with the bearing portion, and hence is less liable to be inadvertently disengaged from the second recess. Accordingly, also in this regard, the platen roller can be retained with high reliability.

Meanwhile, when the platen roller is separated from the recording head, the latch member is rotated about the rotary axis in a direction reverse to that in the above-mentioned case so that the protrusion is disengaged from the second recess. Next, the bearing portion is disengaged from the first recess. With this, the platen roller can be separated from the recording head.

In this manner, the attachment and detachment manipulation of the platen roller can be easily performed with such a simple manipulation that the bearing portion is fitted into or disengaged from inside the first recess and that the protrusion is fitted into or disengaged from inside the second recess due to a rotational movement of the latch member. Accordingly, as described above, the platen roller and the recording head can be quickly combined with each other or quickly separated and disengaged from each other.

Further, the latch member is coupled to the rocking member under a state of being rotatable about the rotary axis that is non-coaxial with the platen axis of the platen roller. Thus, unlike conventional printers in which the rotary axis of the latch member is coaxial with the platen axis, even when being individually and freely designed, the platen roller and the latch member are less liable to have influence on each other. Accordingly, a degree of freedom in designing of the platen roller and the latch member can be enhanced. In addition, a shape of the platen roller is less liable to have influence on strength or movement of the latch member, and hence the platen roller can be reduced in diameter. Accordingly, the printer can be easily downsized as a whole.

(2) According to the printer of the present invention, the rocking member includes a rotary shaft portion projecting to the platen roller side along the rotary axis; and the latch member is rotatably fitted in a covering manner to the rotary shaft portion.

According to the printer of the present invention, the latch member is rotatably fitted in a covering manner to the rotary shaft portion formed on the rocking member. Thus, backlash and the like are less liable to be generated and the latch member is more smoothly rotated. Accordingly, the protrusion can be smoothly fitted into or disengaged from inside the second recess almost without being caught, and hence the attachment and detachment manipulation of the platen roller can be more smoothly performed.

Further, the rotary shaft portion projects to the platen roller side, and hence the latch member can be coupled to the rocking member under a state of being positioned on the same side as that of the platen roller. If the latch member is positioned on the side opposite to the platen roller with the rocking member being interposed therebetween, it is necessary to take a thickness of the rocking member into consideration. Thus, a length of the printer parallel to the platen axis is liable to be elongated in a lateral width direction. However, the latch member is positioned on the same side as that of the platen roller, and hence the printer is easily further downsized without such a risk.

(3) According to the printer of the present invention, the printer further includes an urging member provided between the platen frame and the latch member, for urging the latch member so as to rotate the latch member in a direction in which the protrusion comes close to an inside of the second recess.

According to the printer of the present invention, the latch member is urged by the urging member, and hence the protrusion can be smoothly fitted into the second recess in a shorter period of time after the bearing portion is fitted into the first recess. Accordingly, the platen roller can be more efficiently attached. Further, after the platen roller is attached, due to an urging force of the urging member, the latch member is in a state of being less liable to be rotated in a direction in which the protrusion is disengaged from inside the second recess. Accordingly, the protrusion is less liable to be inadvertently disengaged from inside the second recess, and hence the platen roller can be retained with higher reliability at the time of attachment.

(4) According to the printer of the present invention, the printer further includes a regulating member for regulating a rotational amount of the latch member urged by the urging member.

According to the printer of the present invention, excessive rotation of the latch member can be regulated by the urging member prior to attachment of the platen roller. Accordingly, without influence of the protrusion, the bearing portion is easily fitted into the first recess.

(5) According to the printer of the present invention, the printer further includes: a base member for accommodating a sheet roll formed of a wound recording sheet to be fed between the recording head and the platen roller; and a lid member openably and closably coupled to the base member, in which: the stationary frame is fixed to the base member; and the platen frame is fixed to the lid member.

According to the printer of the present invention, the lid member can be opened and closed in conjunction with the attachment and detachment manipulation of the platen roller, and hence the printer is easy to use. In addition, the recording sheet drawn out from the sheet roll can be easily set between the platen roller and the recording head.

Further, the locking and unlocking of the lid member is performed simultaneously with the attachment and detachment of the platen roller. Thus, it is unnecessary to provide a member dedicated for the locking and unlocking of the lid member, and hence the structure of the printer can be simplified.

(6) According to the printer of the present invention, the lid member includes a manipulation lever for rotating the latch member about the rotary axis.

According to the printer of the present invention, the latch member can be rotated through intermediation of the manipulation lever, and hence the attachment and detachment manipulation of the platen roller can be more easily performed. In particular, the manipulation lever is provided on the lid member, and hence the lid member can be opened and closed with a series of manipulations simultaneously with the manipulation of the manipulation lever, which leads to enhancement of manipulation properties.

According to the printer of the present invention, the attachment and detachment manipulation of the platen roller can be easily performed, and the platen roller can be retained with high reliability at the time of attachment. Further, reduction of a diameter of the platen roller can be achieved, and downsizing of the entire printer is easily achieved.

DETAILED DESCRIPTION OF THE PREFERRED EMBODIMENT

In the following, description is made of an embodiment according to the present invention with reference to FIGS. 1 to 14. In this embodiment, description is made of a thermal printer as an example of a printer.

Figure 1:
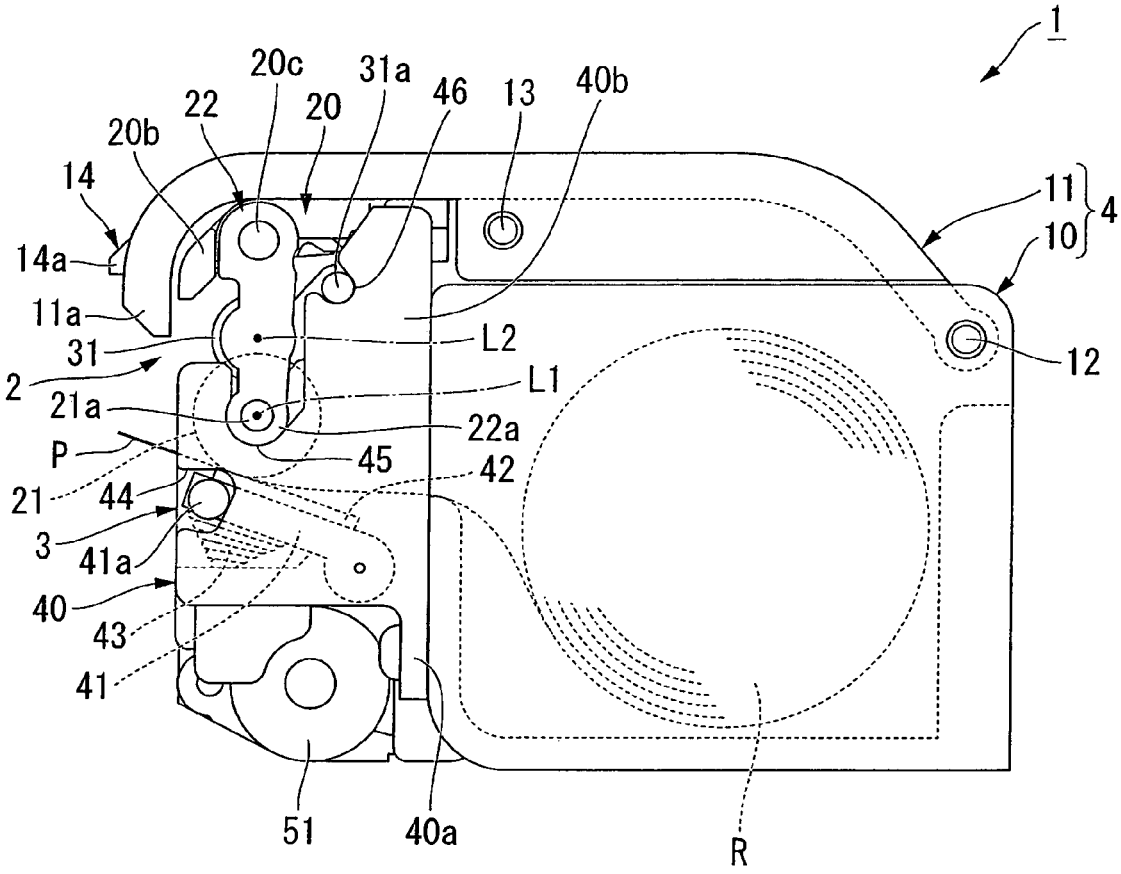
FIG. 1 is a side view of a printer according to an embodiment of the present invention, illustrating a state in which a platen unit and a main unit are combined with each other.
Figure 2:
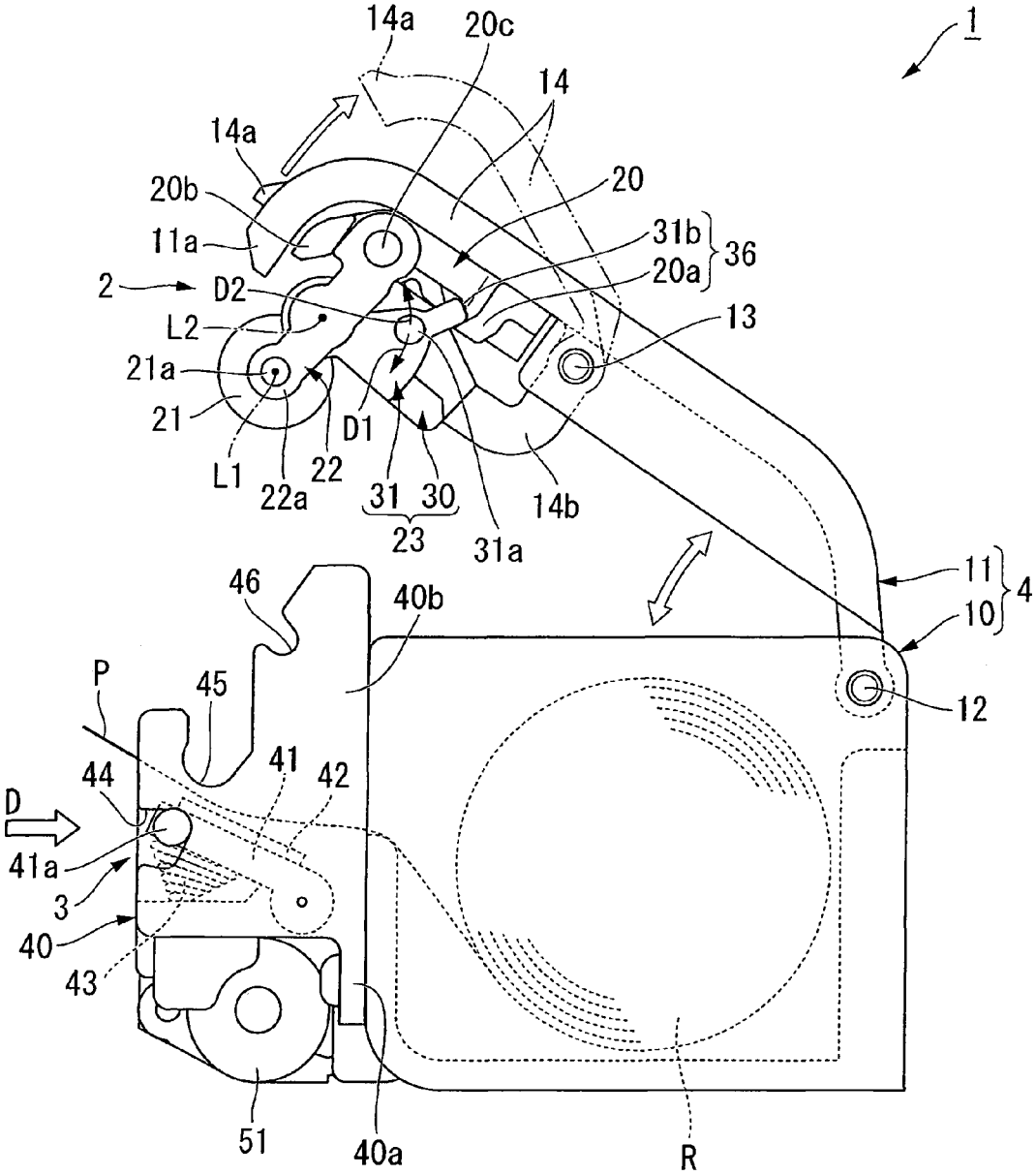
FIG. 2 is a side view illustrating a state in which the platen unit and the main unit in the state illustrated in FIG. 1 are disengaged from each other and a lid member is largely opened.

As illustrated in FIGS. 1 and 2, a printer 1 according to this embodiment includes a platen unit 2 and a main unit 3 which are separably combined with each other and a casing 4 for accommodating a sheet roll R formed of a wound recording sheet P.

FIG. 1 is an overall side view of the printer 1 in a state in which the platen unit 2 and the main unit 3 are combined with each other. FIG. 2 is an overall side view illustrating a state in which the platen unit 2 and the main unit 3 in the state illustrated in FIG. 1 have been separated from each other.

First, Description is Made of the Casing 4.

The casing 4 according to this embodiment includes a base member 10 and a lid member 11 openably and closably (rotatably) coupled to the base member 10 through intermediation of a rotary shaft 12.

The base member 10 is made of a resin material or the like in a box shape and an upper side thereof is open so that the sheet roll R is accommodated therein. The lid member 11 is made of a resin material as well as the base member 10, and functions to expose an opening of the base member 10 in an opened state and cover the opening of the base member 10 in a closed state. Note that, locking and unlocking of the lid member 11 is effected by attachment and detachment of the platen unit 2 and the main unit 3.

Further, the lid member 11 is formed to extend outward beyond the base member 10 (to the left side of the drawing sheets of FIGS. 1 and 2), and the platen unit 2 is fixed to an inner surface of the extended part. Note that, a distal end portion 11*a* of the lid member 11 extending outward beyond the base member 10 is curved downward, and covers a part of the platen unit 2 from the outside. Further, a manipulation lever 14 is rotatably coupled to a surface side of the lid member 11 through intermediation of a rotary shaft 13. Description of the manipulation lever 14 is made later.

Next, Description is Made of the Platen Unit 2.

As illustrated in FIGS. 3 to 6, the platen unit 2 includes: a platen frame 20 fixed to the inner surface of the lid member 11; a platen roller 21 for feeding the recording sheet P; rocking members 22 each including a bearing portion 22*a* for axially supporting the platen roller 21, the rocking members 22 being fixed to the platen frame 20 so as to be rockable under a state of axially supporting the platen roller 21; and a latch member 23 rotatably coupled to the rocking members 22.

Figure 3:
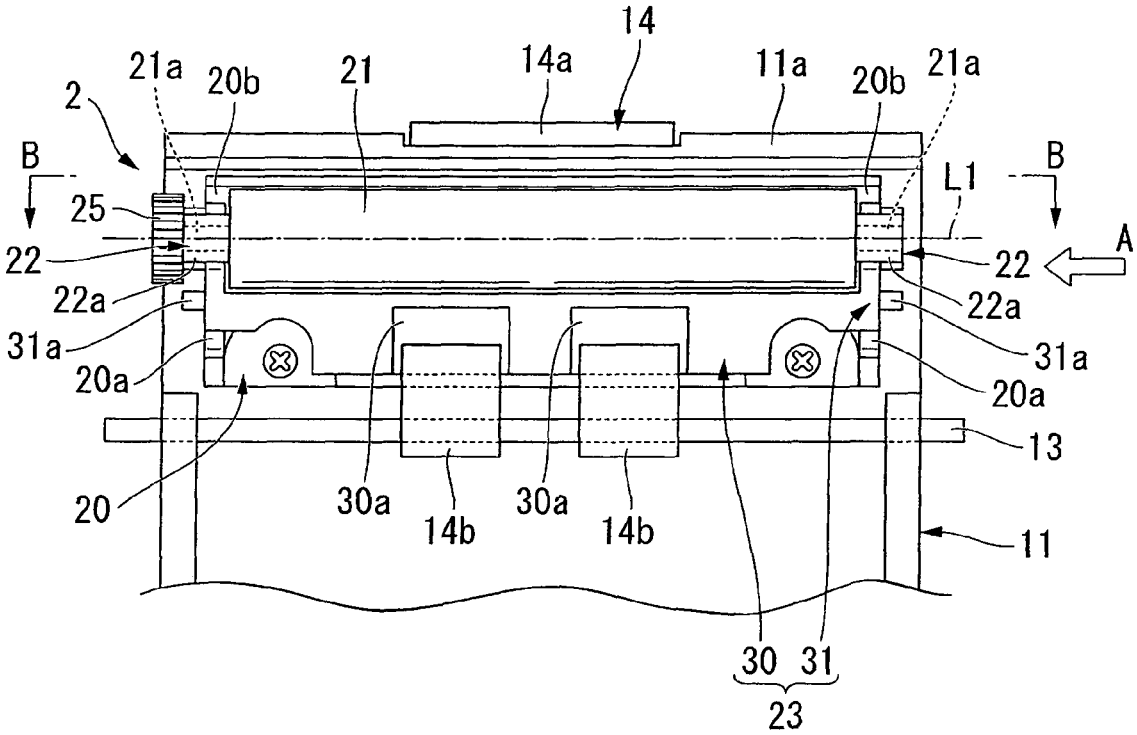
FIG. 3 is a front view of the platen unit in a state of being fixed to an inner surface of the lid member illustrated in FIG. 2.
Figure 4:
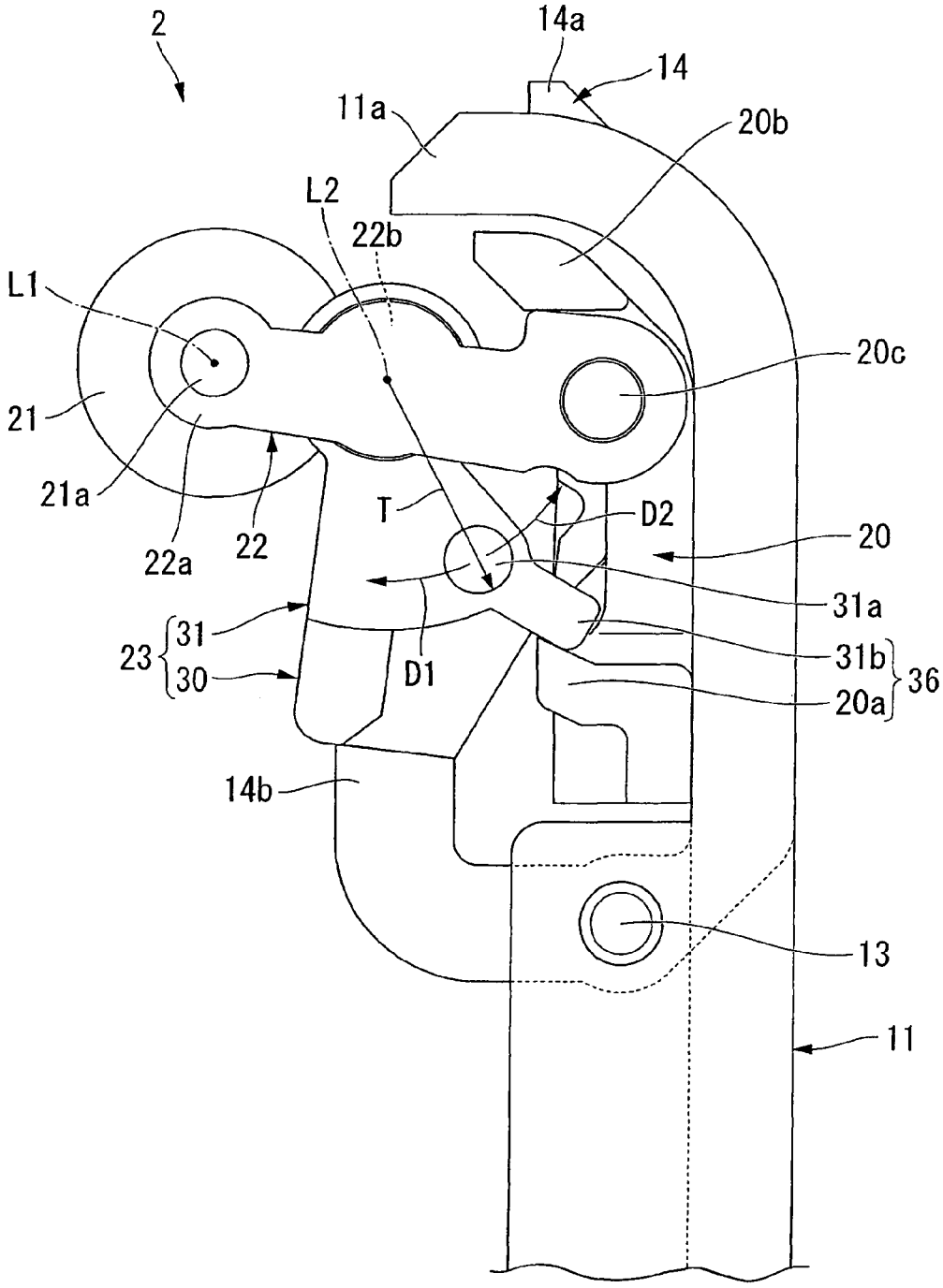
FIG. 4 is a side view of the platen unit and the lid member, seen from a direction of the arrow A illustrated in FIG. 3.
Figure 5:
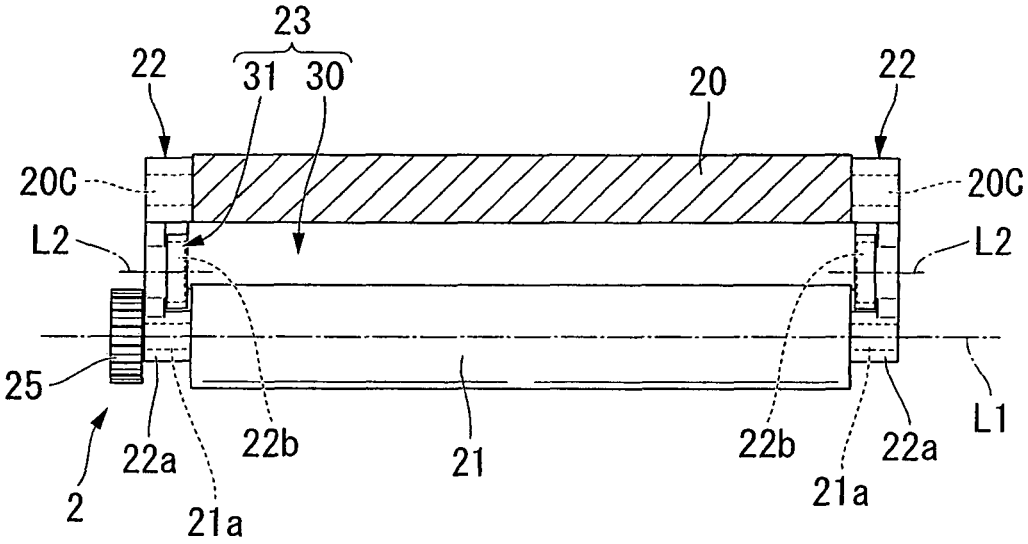
FIG. 5 is a top view of the platen unit taken along the line B-B illustrated in FIG. 3.
Figure 6:
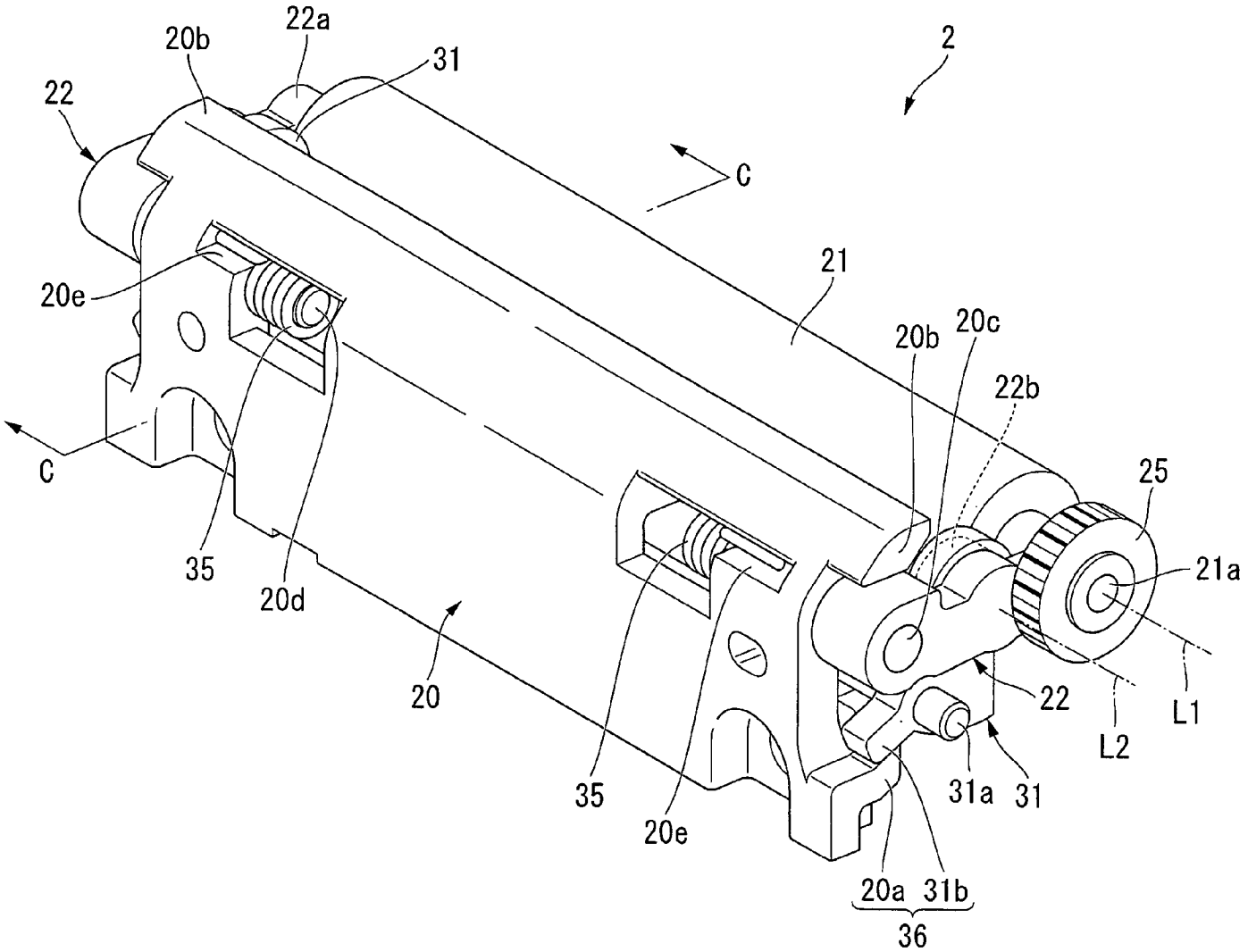
FIG. 6 is an outer appearance perspective view of the platen unit, seen from a platen frame side.

Note that, FIG. 3 is a front view of the platen unit 2 in a state of being fixed to the inner surface of the lid member 11. FIG. 4 is a side view of the platen unit 2 and the lid member 11, seen from a direction of the arrow A illustrated in FIG. 3. FIG. 5 is a top view of the platen unit 2 taken along the line B-B illustrated in FIG. 3. FIG. 6 is an outer appearance perspective view of the platen unit 2, seen from the platen frame 20 side.

As illustrated in FIG. 3, the platen frame 20 is formed to have a lateral width slightly narrower than a lateral width of the lid member 11 and formed in a substantially plate-like shape. The platen frame 20 is fixed so as to overlap the most part of the inner surface of the lid member 11 with fastening means such as a screw.

On each side on one end side (rotary shaft 13 side) of the platen frame 20, as illustrated in FIGS. 3, 4, and 6, there is formed a first stopper claw 20*a* protruding to the platen roller 21 side. Further, on each side on another end side (distal end portion 11*a* side of the lid member 11) of the platen frame 20, there is formed a second stopper claw 20*b* protruding in a direction parallel to a platen axis L1 of the platen roller 21.

As illustrated in FIGS. 3 to 6, the platen roller 21 is a roller being made of an elastic material and extending along the platen shaft L1, and has both end portions from which a platen shaft 21*a* projects. As described above, the platen roller 21 is axially supported by the rocking members 22.

The rocking members 22 are arranged in a manner of sandwiching the platen roller 21, and each has a root side rotatably coupled to a coupling pin 20*c* projecting in the direction parallel to the platen axis L1 from corresponding one side of the platen frame 20. By this construction, the rocking members 22 are rockable about the coupling pins 20*c*.

The bearing portions 22*a* are formed on distal end sides of the rocking members 22, and axially support the platen shaft 21*a* projecting from both the end portions of the platen roller 21. By this construction, the platen roller 21 is axially supported by the rocking members 22 and coupled to the platen frame 20 through intermediation of the rocking members 22.

Further, at a middle portion (substantially the middle between the root side and the distal end side on which the bearing portion 22*a* is formed) of each of the rocking members 22, there is formed a rotary shaft portion 22*b* projecting to the platen roller 21 side along a rotary axis L2 that is non-coaxial with and parallel to the platen axis L1. The rotary shaft portion 22*b* functions as a shaft portion to which a coupling plate 31 of the latch member 23 described later is rotatably fitted in a covering manner.

It is noted that a driven gear 25 is fixed on one side of the platen shaft 21*a* with one of the rocking members 22 being interposed therebetween. The driven gear 25 is rotated by a rotational force transmitted thereto when the platen unit 2 and the main unit 3 are combined with each other and the driven gear 25 meshes with a platen gear train 50 described later. By this construction, the platen roller 21 is capable of being rotated about the platen axis L1 in accordance with rotation of the driven gear 25 so as to feed the recording sheet P drawn out from the sheet roll R.

The latch member 23 is arranged below the platen roller 21, and includes a base portion 30 formed to have a length substantially the same as that of the platen roller 21, and the coupling plate 31 which is formed in a fan shape in plan view, provided continuously with each end portion of the base portion 30, and rotatably coupled to the rocking members 22.

As illustrated in FIG. 3, at a middle portion of the base portion 30, there are formed two recesses 30*a* at an interval in a lateral width direction, into which claw portions 14*b* of the manipulation lever 14 described later intrude so as to be held in contact therewith.

As illustrated in FIGS. 3 to 6, the coupling plate 31 is partially formed in a ring shape, and this part is rotatably fitted to the above-mentioned rotary shaft portion 22*b* of each of the rocking members 22. With this, the latch member 23 is coupled to the rocking members 22 in a rotatable state about the rotary axis L2 that is non-coaxial with the platen axis L1.

Further, to the coupling plate 31, there are provided a fixing pin (protrusion) 31*a* projecting in the direction parallel to the platen axis L1 and being rotationally moved about the rotary axis L2 in accordance with rotation of the latch member 23, and an engaging protrusion 31*b* projecting to the platen frame 20 side.

Note that, a distance from the rotary axis L2 to an outer periphery of the fixing pin 31*a* is defined as a distance T (refer to FIG. 4), and set to be uniform irrespective of the rotation of the latch member 23.

Figure 7:
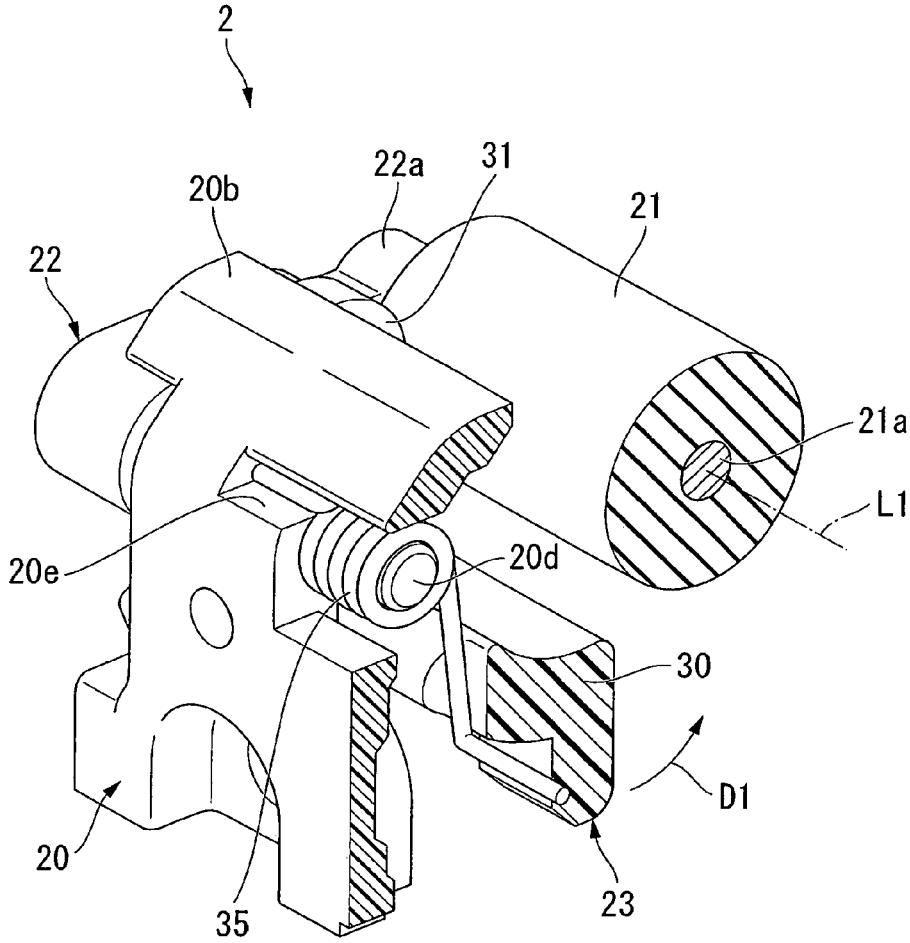
FIG. 7 is a partially sectional perspective view of the platen unit taken along the line C-C illustrated in FIG. 6.

As illustrated in FIGS. 6 and 7, the latch member 23 structured as described above is urged by torsional springs (urging members) 35 so as to be rotated in a direction in which the fixing pin 31*a* comes close to an inside of corresponding one of second recesses 46 described later, that is, in a direction of being spaced apart from the platen frame 20 (hereinafter, referred to as locking direction D1). Note that, FIG. 7 is a partially sectional perspective view of the platen unit 2 taken along the line C-C illustrated in FIG. 6.

Each of the torsional springs 35 is arranged between the platen frame 20 and the latch member 23. Specifically, each of the torsional springs 35 is fitted in a covering manner to a supporting pin 20*d* formed on the platen frame 20 side, and has one end side fitted into a groove portion 20*e* formed on a root side of the supporting pin 20*d* and another end side held in back-to-back contact with the base portion 30 of the latch member 23 so as to urge the latch member 23. With this, the latch member 23 is maintained under a state of being urged to be rotated about the rotary axis L2 in the locking direction D1.

In this case, as illustrated in FIG. 4, by engagement of the engaging protrusion 31*b* formed on the coupling plate 31 with the first stopper claw 20*a* on the platen frame 20 side, a rotational amount is regulated so that the latch member 23 is not excessively rotated. With this, prior to combination of the platen unit 2 and the main unit 3, the fixing pin 31*a* is not excessively spaced apart from the platen frame 20.

The first stopper claw 20*a* and the engaging protrusion 31*b* function as a regulating member 36 for regulating the rotational amount of the latch member 23 urged by the torsional springs 35.

Further, although the rocking members 22 may rock in the locking direction D1 together with the latch member 23 urged by the torsional springs 35, a rocking amount in the locking direction D1 is regulated because the rocking members 22 come into contact with the second stopper claw 20*b* formed on the platen frame 20 side. That is, prior to the combination of the platen unit 2 and the main unit 3, the platen roller 21 is designed not to be excessively moved to the distal end portion 11*a* side of the lid member 11.

By the way, as illustrated in FIGS. 2 and 4, with the manipulation lever 14 rotatably coupled to a surface of the lid member 11, the above-mentioned latch member 23 is rotated in a direction in which the fixing pin 31*a* is disengaged from inside corresponding one of the second recesses 46 described later, that is, in the direction of coming close to the platen frame 20 (hereinafter, referred to as release direction D2).

In other words, the manipulation lever 14 according to this embodiment functions as an open lever for disengaging the platen unit 2 and the main unit 3 from each other and achieving an opened state of the lid member 11.

In detail, the manipulation lever 14 is formed in a J-shape in side view, and includes a manipulation end 14*a* formed on a distal end side thereof positioned on the distal end portion 11*a* side of the lid member 11. Meanwhile, a proximal end side of the manipulation lever 14 is coupled to the lid member 11 through intermediation of the rotary shaft 13, and the claw portions 14*b* extend, on an inner surface side of the lid member 11, from the coupled portion to the latch Member 23. The claw portions 14*b* are held in contact with the base portion 30 while intruding into the recesses 30*a* formed in the base portion 30 (refer to FIG. 3).

As just described, the claw portions 14*b* are held in contact with the base portion 30, and hence, when the manipulation lever 14 is subjected to a pulling-up manipulation (opening manipulation) through intermediation of the manipulation end 14*a*, the manipulation lever 14 is rotated about the rotary shaft 13 so that the claw portions 14*b* press the base portion 30 to the platen frame 20 side. With this, the latch member 23 is rotated about the rotary axis L2 in the release direction D2 in which the fixing pin 31*a* comes close to the platen frame 20.

Next, description is made of the main unit 3.

Figure 8:
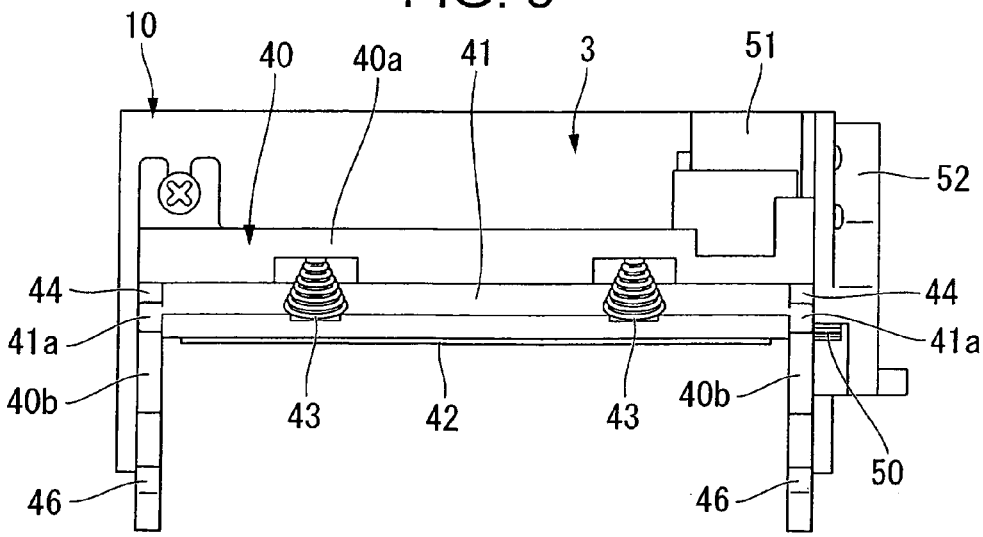
FIG. 8 is a side view of the main unit, seen from a direction of the arrow D illustrated in FIG. 2.

As illustrated in FIGS. 1, 2, and 8, the main unit 3 includes a stationary frame 40 fixed to the base member 10 and a thermal head (recording head) 42 fixed to the stationary frame 40 through intermediation of a head support body 41, and is arranged so as to face the platen unit 2. Note that, FIG. 8 is a side view of the main unit 3, seen from a direction of the arrow D illustrated in FIG. 2.

The stationary frame 40 is formed in a C-shape in plan view of a frame body portion 40*a* and facing wall portions 40*b* provided continuously with both sides of the frame body portion 40*a* so as to face each other, and is fixed to the base member 10 with the fastening means such as a screw.

The thermal head 42 includes many heat-generating elements (not shown) aligned parallel to the platen axis L1, and is secured to a front surface of the head support body 41. A flexible substrate (not shown) is connected to the thermal head 42 so that drive signals for selectively driving the heat-generating elements are input.

The head support body 41 is rockably fixed to the stationary frame 40. Between the head support body 41 and the frame body portion 40*a*, there are provided coil springs 43 for bringing, by urging the head support body 41, the thermal head 42 into pressure-contact with the platen roller 21 when the platen unit 2 and the main unit 3 are combined with each other. With this, at the time of printing, sheet feeding can be performed while printing is reliably performed on the recording sheet P.

Note that, a regulating pin 41*a* is formed at each end of the head support body 41, and intrudes into corresponding one of groove portions 44 formed on the stationary frame 40 side. Thus, the head support body 41 is regulated in rocking amount so as not to excessively rock.

The bearing portion 22*a* of each of the rocking members 22 is disengageably fitted into corresponding one of the facing wall portions 40*b* of the stationary frame 40. The facing wall portions 40*b* each include a first recess 45 for retaining the platen roller 21 at a position of facing the thermal head 42, and the second recess 46 into which, after the bearing portion 22*a* is fitted into the first recess 45, the fixing pin 31*a* is fitted due to the rotation of the latch member 23.

In particular, the bearing portion 22*a* of each of the rocking members 22 is disengageable from inside the first recess 45 while the fixing pin 31*a* is fitted in the second recess 46, and is undisengageable from inside the first recess 45 after the fixing pin 31*a* is disengaged from inside the second recess 46.

Detailed description is made of the first recess 45 and the second recess 46.

Figure 9:
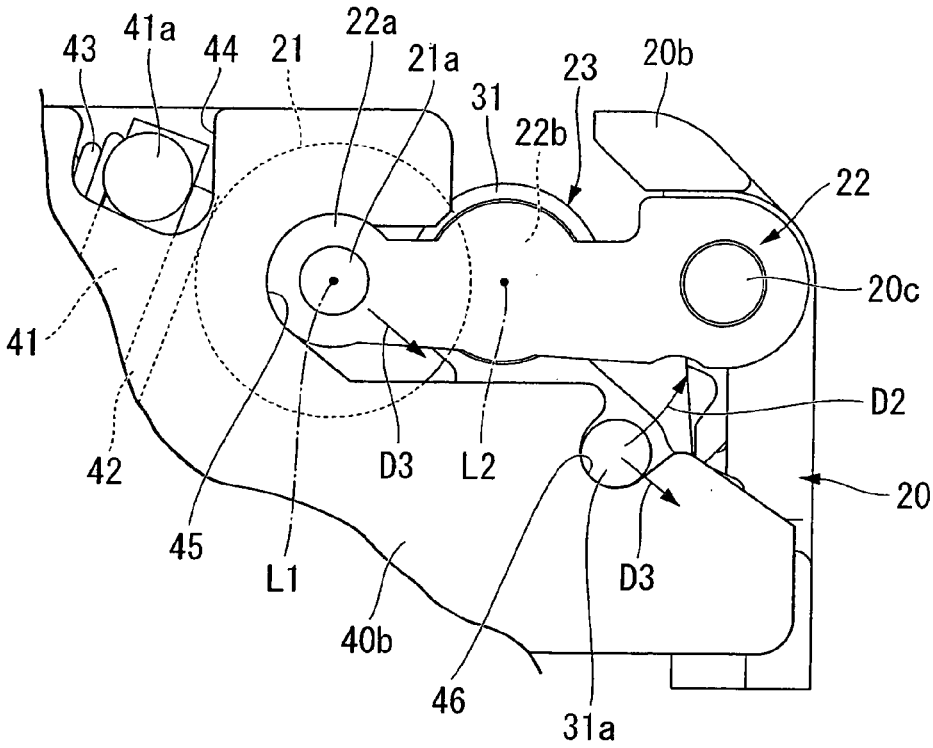
FIG. 9 is an enlarged view of a vicinity of a rocking member in the state illustrated in FIG. 1, illustrating a state in which a bearing portion is fitted in a first recess and a fixing pin is fitted in a second recess.

First, as illustrated in FIG. 9, the first recess 45 is formed so that an inner periphery thereof partially hinders the rocking member 22 from being rotated about the coupling pin 20*c* while the bearing portion 22*a* and the fixing pin 31*a* are respectively fitted in the first recess 45 and the second recess 46. With this, under a state in which the fixing pin 31*a* is fitted in the second recess 46, it is impossible for the bearing portion 22*a* to be disengaged from inside the first recess 45.

Note that, FIG. 9 is an enlarged view of a vicinity of one of the rocking members 22 in the state illustrated in FIG. 1, illustrating a state in which the bearing portion 22*a* is fitted in the first recess 45 and the fixing pin 31*a* is fitted in the second recess 46.

Further, as described above, the bearing portion 22*a* is hindered from rocking owing to interference of the inner periphery of the first recess 45. Thus, in order for the bearing portion 22*a* to be disengaged from inside the first recess 45 under the state in which the fixing pin 31*a* is fitted in the second recess 46, the bearing portion 22*a* is required to be moved in a direction of an arrow D3, that is, an opening direction of the first recess 45. However, the second recess 46 is formed so that an inner periphery thereof partially hinders the fixing pin 31*a* from being moved in the direction of the arrow D3.

Accordingly, unless the inner periphery of the second recesses 46 allows the fixing pin 31*a* to move in the direction of the arrow D3, the bearing portion 22*a* is not allowed to move in the direction of the arrow D3 either. Therefore, it is impossible for the bearing portion 22*a* and the fixing pin 31*a* to be simultaneously disengaged from the first recess 45 and the second recess 46, respectively.

However, the second recess 46 is provided with an opening so as to allow the fixing pin 31*a* to move about the rotary axis L2 in the release direction D2. Accordingly, by rotation of the latch member 23 about the rotary axis L2 in the release direction D2, the fixing pin 31*a* can be easily disengaged from inside the second recess 46. After the fixing pin 31*a* is disengaged from inside the second recess 46, the bearing portion 22*a* can be easily disengaged from inside the first recess 45.

In this manner, only in order of disengaging first the fixing pin 31*a* from inside the second recess 46 and then disengaging the bearing portion 22*a* from inside the first recess 45, the platen roller 21 can be separated from the stationary frame 40, that is, the platen unit 2 and the main unit 3 can be separated from each other.

Further, as illustrated in FIG. 8, on the stationary frame 40 according to this embodiment, the platen gear train 50 to mesh with the driven gear 25 is arranged on an outside of one of the facing wall portions 40*b*. The platen gear train 50 is rotated by driving of a platen drive motor 51 fixed on a back surface side of the stationary frame 40, and functions to transmit a rotational force to the driven gear 25. Note that, the platen gear train 50 is protected by a gear cover 52.

Next, description is made of work of the printer 1 structured as described above.

First, description is made on the premise that, as illustrated in FIG. 1, the sheet roll R is accommodated in the base member 10 and the platen unit 2 and the main unit 3 are combined with each other under a state in which the recording sheet P is drawn to the outside. In this case, the lid member 11 is in the closed state of closing the opening of the base member 10 and is locked by the combination of the platen unit 2 and the main unit 3. Thus, unless the platen unit 2 and the main unit 3 are separated from each other, the lid member 11 does not enter the opened state. Further, the recording sheet P is in a state of being sandwiched between the platen roller 21 and the thermal head 42 pressed by the platen roller 21.

In order to perform printing of various pieces of information onto the recording sheet P, the thermal head 42 is activated simultaneously with driving of the platen drive motor 51.

First, when the platen drive motor 51 is driven, a rotational force generated thereby is transmitted to the driven gear 25 through intermediation of the platen gear train 50, and hence the platen roller 21 is rotated. With this, the recording sheet P sandwiched between the platen roller 21 and the thermal head 42 is fed. Meanwhile, the many heat-generating elements appropriately generate heat due to activation of the thermal head 42. With this, various characters, graphic symbols, and the like can be clearly printed onto the recording sheet P which has been fed.

In particular, under the state in which the platen unit 2 and the main unit 3 are combined with each other, as illustrated in FIG. 9, the bearing portion 22*a* of the rocking member 22 is fitted in the first recess 45 and the fixing pin 31*a* of the latch member 23 is fitted in the second recess 46. Thus, even when an external force is transmitted to the platen roller 21 from the thermal head 42, the recording sheet P, and the like during printing, the bearing portion 22*a* is prevented from being disengaged from inside the first recess 45. Thus, the platen roller 21 can be retained with high reliability. As a result, the recording sheet P can be accurately fed, and in addition, printing can be performed without involving thin spots, blurs, or the like.

Note that, even when being exposed to an external force from the platen roller 21, the recording sheet P, and the like during printing, the fixing pin 31*a* is less liable to be disengaged from inside the second recess 46 even with inadvertent rotation of the latch member 23. Accordingly, also in this regard, the platen roller 21 can be retained with high reliability.

In particular, the latch member 23 is not in a state of being liable to be rotated in the release direction D2 in which the fixing pin 31*a* is disengaged from inside the second recess 46 by an urging force of the torsional spring 35. Accordingly, the fixing pin 31*a* is less liable to be inadvertently disengaged from inside the second recess 46 during printing. Also in this regard, the platen roller 21 can be reliably retained.

Next, description is made of a case where the platen unit 2 and the main unit 3 are disengaged from each other so that the platen roller 21 is separated from the thermal head 42.

Figure 10:
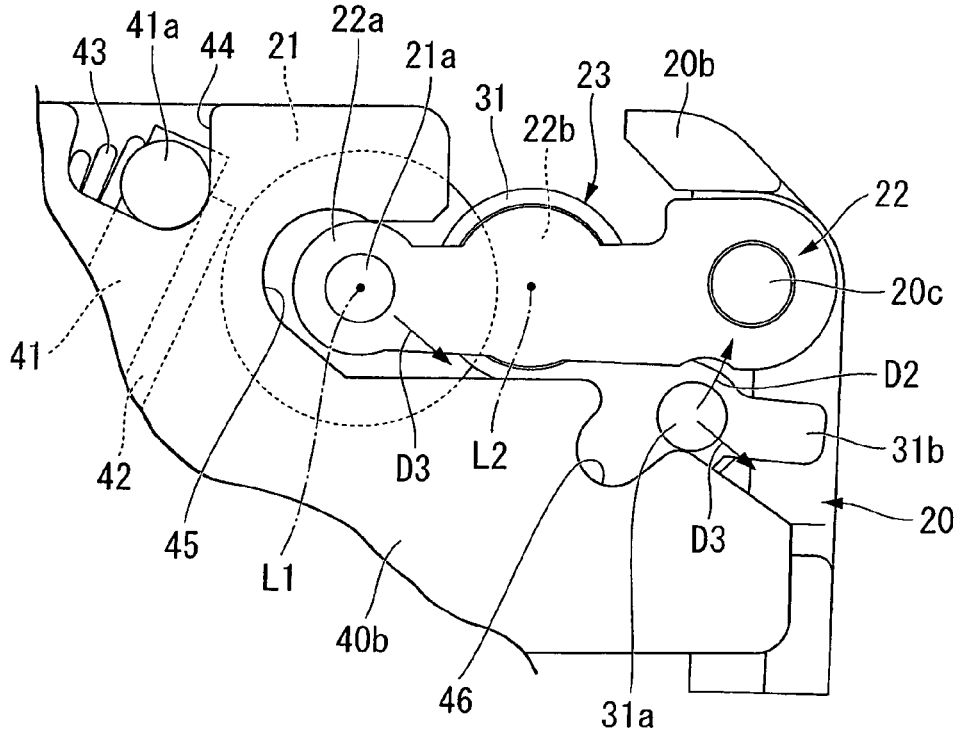
FIG. 10 illustrates a state in which the fixing pin in the state illustrated in FIG. 9 has got out from the second recess.

In this case, first, the manipulation end 14*a* of the manipulation lever 14 is pulled up so that the manipulation lever 14 is rotated about the rotary shaft 13. Then, the claw portions 14*b* of the manipulation lever 14 press the base portion 30 of the latch member 23 to the platen frame 20 side with a force resisting the torsional springs 35. Thus, the latch member 23 is rotated about the rotary axis L2 in the release direction D2 as illustrated in FIG. 10, and the fixing pin 31*a* is disengaged from inside each of the second recesses 46.

With this, both the bearing portions 22*a* and the fixing pins 31*a* enter a movable state in the direction of the arrow D3, that is, the opening direction of the first recess 45. In other words, the lid member 11 enters an unlocked state.

Through rotating the lid member 11 about the rotary shaft 12, simultaneously with pulling-up of the manipulation lever 14, so as to effect opening movement, both the bearing portion 22*a* and the fixing pin 31*a* move in the direction of the arrow D3, that is, the opening direction of the first recess 45. As a result, the bearing portion 22*a* starts to be gradually disengaged from inside the first recess 45. In this case, the rocking member 22 appropriately rocks about the root side thereof, and the latch member 23 is appropriately rotated about the rotary axis L2. Thus, the bearing portion 22*a* and the fixing pin 31*a* smoothly move in the direction of the arrow D3 without being caught.

Figure 11:
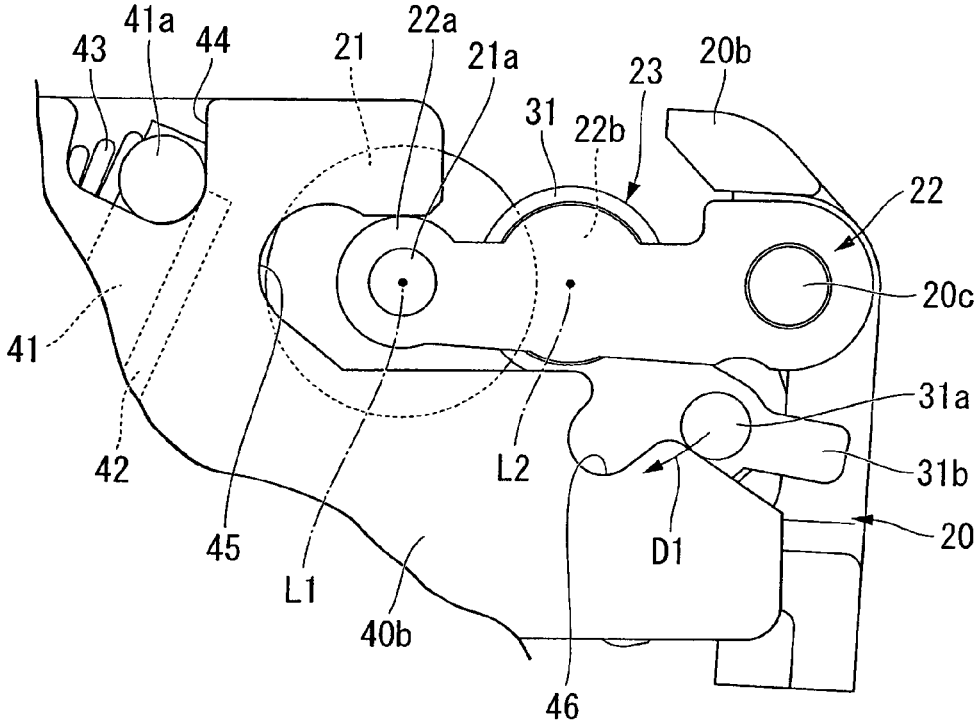
FIG. 11 illustrates a state in which the bearing portion and the fixing pin in the state illustrated in FIG. 10 have moved in a manner of being spaced respectively apart from the first recess and the second recess.
Figure 12:
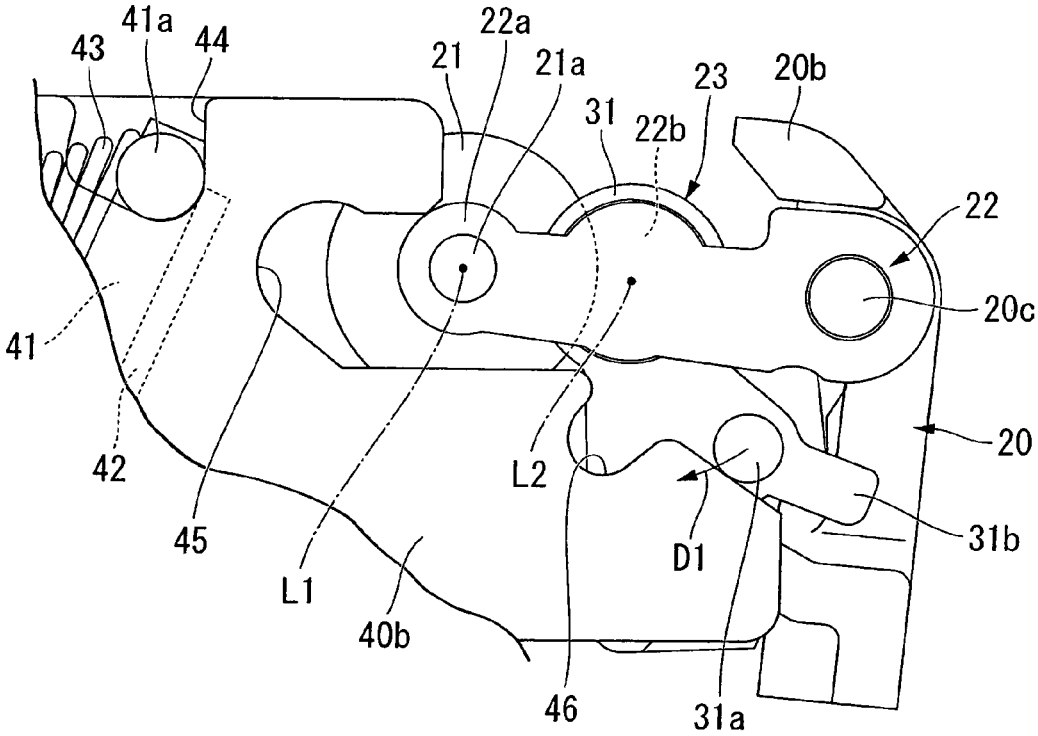
FIG. 12 illustrates a state in which the bearing portion and the fixing pin in the state illustrated in FIG. 11 have moved in a manner of being further spaced respectively apart from the first recess and the second recess.
Figure 13:
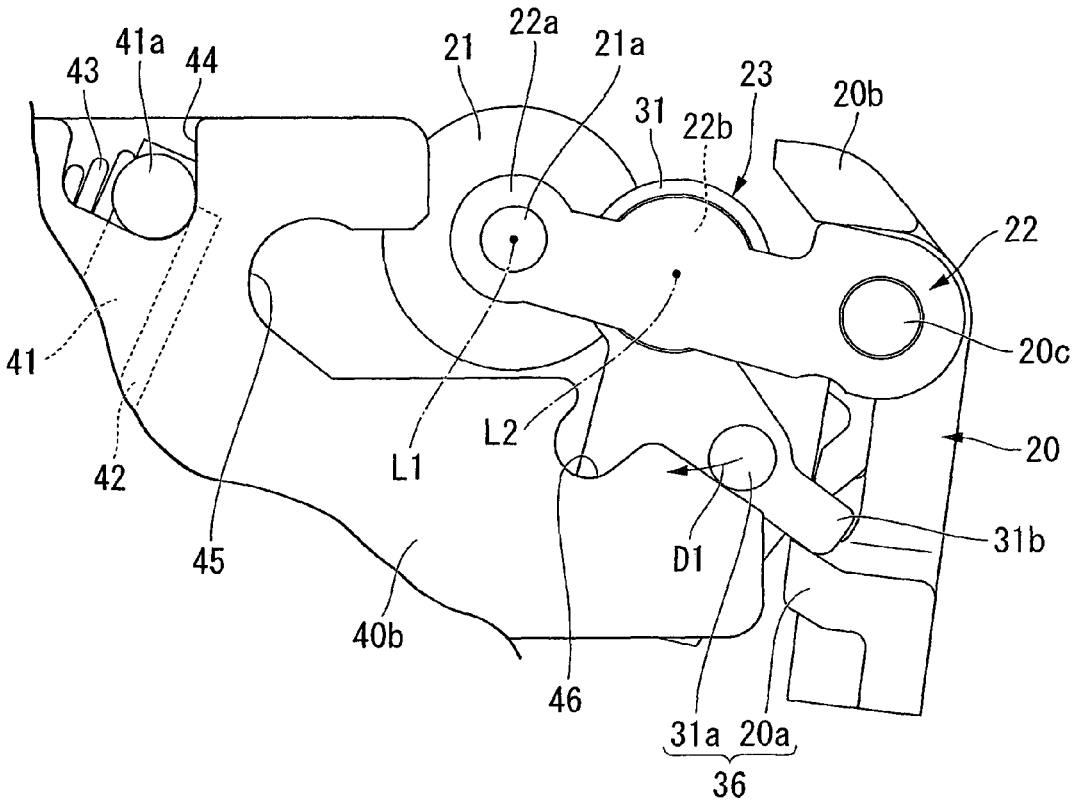
FIG. 13 illustrates a state in which the bearing portion in the state illustrated in FIG. 12 has been completely disengaged from the first recess.

Then, when the opening movement of the lid member 11 is further proceeded, the bearing portion 22*a* and the fixing pin 31*a* further move as illustrated in FIGS. 11 and 12. When the opening movement of the lid member 11 is still further proceeded, the bearing portion 22*a* can be completely disengaged from inside the first recess 45 as illustrated in FIG. 13. At this time, the engaging protrusion 31*b* of the latch member 23 is engaged with the first stopper claw 20*a* on the platen frame 20 side.

With this, excessive rotation of the latch member 23 urged by the torsional springs 35 can be regulated. Further, the rocking members 22 come into contact with the second stopper claws 20*b* on the platen frame 20 side as well, and hence excessive rocking of both the rocking members 22 and the platen roller 21 can be regulated.

As just described, by complete disengagement of the bearing portion 22*a* from inside the first recess 45, the platen unit 2 and the main unit 3 are disengaged from each other. As a result, the platen roller 21 can be detached from the thermal head 42. After that, by large opening of the lid member 11 as illustrated in FIG. 2, replacement of the sheet roll R, various maintenance operations, and the like can be performed.

Next, description is made of a case where the platen unit 2 and the main unit 3 are combined with each other after the platen roller 21 is attached. In this case, basically, a process reverse to the above-mentioned process is performed.

First, as illustrated in FIG. 2, under a state in which the lid member 11 is largely opened, the recording sheet P is pulled out by a certain length in advance. After that, the lid member 11 is closed, and the fixing pin 31*a* is brought into contact with the facing wall portion 40*b* of the stationary frame 40 as illustrated in FIG. 13. Then, the lid member 11 is further closed from this state, and the bearing portion 22*a* is inserted into the first recess 45 as illustrated in FIG. 12.

In this case, the fixing pin 31*a* moves in accordance with closing movement of the lid member 11 while being held in contact with the facing wall portion 40*b* of the stationary frame 40. Simultaneously, in accordance with the closing movement of the lid member 11, the latch member 23 is rotated about the rotary axis L2 in the release direction D2 with the force resisting the torsional springs 35. Thus, the engaging protrusion 31*b* enters a state of being spaced apart from the first stopper claw 20*a*. Further, in accordance with the rotation of the latch member 23, the rocking member 22 rocks in a direction of being spaced apart from the second stopper claw 20*b*, and hence the bearing portion 22*a* is easily and smoothly inserted into the first recess 45.

Then, by further closing of the lid member 11, as illustrated in FIG. 11, both the bearing portion 22*a* and the fixing pin 31*a* can be moved while being held in contact with the facing wall portion 40*b* of the stationary frame 40. After that, as illustrated in FIG. 10, the bearing portion 22*a* can be fitted into the first recess 45. Then, when the lid member 11 is still further closed from this state, as illustrated in FIG. 9, the fixing pin 31*a* is automatically inserted and fitted into the second recess 46. In other words, the latch member 23 is urged by the torsional springs 35, and hence, when reaching an opening of the second recess 46, the fixing pin 31*a* is automatically fitted into the second recess 46.

With this, mounting of the platen roller 21 is completed and a printable state can be achieved. Simultaneously, the bearing portion 22*a* can be set to be undisengageable from inside the first recess 45. Further, the lid member 11 can be locked in the closed state. In other words, the state illustrated in FIG. 1 can be achieved.

As described above, according to the printer 1 of this embodiment, the attachment and detachment manipulation of the platen roller 21 can be easily performed with such a simple manipulation that the bearing portion 22*a* is fitted into or disengaged from inside the first recess 45, and that the fixing pin 31*a* is fitted into or disengaged from inside the second recess 46 due to rotational movement of the latch member 23. Accordingly, the platen roller 21 and the thermal head 42 (platen unit 2 and the main unit 3) can be quickly combined with or quickly separated and disengaged from each other.

In addition, the latch member 23 is urged by the torsional springs 35, and hence the fixing pin 31*a* can be smoothly fitted into the second recess 46 in a short period of time after the bearing portion 22*a* is fitted into the first recess 45. Accordingly, the platen roller 21 can be more efficiently attached.

Further, when the platen roller 21 is attached after the platen unit 2 and the main unit 3 are combined with each other, unless the fixing pin 31*a* is intentionally disengaged from inside the second recess 46, the bearing portion 22*a* is not disengaged from inside the first recess 45. Thus, the platen roller 21 can be retained with high reliability. Accordingly, feeding of and printing onto the recording sheet P can be reliably performed, and hence reliability of the printer 1 can be enhanced.

Further, the latch member 23 according to this embodiment is coupled to the rocking members 22 under a state of being rotatable about the rotary axis L2 that is non-coaxial with the platen axis L1 of the platen roller 21. Thus, unlike conventional printers in which the rotary axis L2 of the latch member 23 is coaxial with the platen axis L1, individual and free designing of the platen roller 21 and the latch member 23 is less liable to have influence on the counterpart. Accordingly, a degree of freedom in design can be enhanced.

In particular, a size, a shape, and the like of the platen roller 21 are less liable to have influence on strength or movement of the latch member 23, and hence the platen roller 21 can be reduced in diameter. Accordingly, the printer can be easily downsized as a whole.

Further, in this embodiment, the latch member 23 is rotatably fitted in a covering manner to the rotary shaft portion 22*b* formed on the rocking member 22. Thus, backlash and the like are less liable to be generated and the latch member 23 is smoothly rotated. Accordingly, the fixing pin 31*a* can be smoothly fitted into or disengaged from inside the second recess 46 almost without being caught, and hence the attachment and detachment manipulation of the platen roller 21 can be smoothly performed.

Further, the rotary shaft portion 22*b* projects to the platen roller 21 side, and hence the latch member 23 can be coupled to the rocking members 22 under a state of being positioned on the same side as that of the platen roller 21. If the latch member 23 is positioned on the side opposite to the platen roller 21 with the rocking members 22 being interposed therebetween, it is necessary to take a thickness of the rocking members 22 into consideration. Thus, a length of the printer 1 parallel to the platen axis L1 is liable to be elongated in the lateral width direction. However, the latch member 23 may be positioned on the same side as that of the platen roller 21, and hence the printer 1 is easily downsized without such a risk.

Further, the lid member 11 can be opened and closed in conjunction with the attachment and detachment manipulation of the platen roller 21, and hence the printer 1 is easy to use. In addition, the recording sheet P drawn out from the sheet roll R can be easily set between the platen roller 21 and the thermal head 42. Further, the locking and unlocking of the lid member 11 is performed simultaneously with the attachment and detachment of the platen roller 21. Thus, it is unnecessary to provide a member dedicated for the locking and unlocking of the lid member 11, and hence the structure of the printer 1 can be simplified.

Still further, the latch member 23 can be rotated through intermediation of the manipulation lever 14, and hence the attachment and detachment manipulation of the platen roller 21 can be more easily performed. In particular, the manipulation lever 14 is provided on the lid member 11, and hence the lid member 11 can be opened and closed with a series of manipulations simultaneously with the manipulation of the manipulation lever 14, which leads to enhancement of manipulation properties.

Note that, the technical scope of the present invention is not limited to the above description in this embodiment, and various modifications can be made thereto without departing from the spirit of the present invention.

For example, as described above in this embodiment, the casing 4 including the base member 10 and the lid member 11 is not essential, and hence is not required to be provided. That is, functions as a printer can be sufficiently exerted only with the main unit 3 and the platen unit 2.

Further, as described above in this embodiment, although the rotary shaft portions 22*b* of the rocking members 22 are formed so as to project to the platen roller 21 side, this should not be construed restrictively. The rotary shaft portions 22*b* may be formed so as to project to the outside opposite to the platen roller 21 side. In this case, although the latch member 23 is coupled to the rocking members 22 under a state of being positioned on the side opposite to the platen roller 21 side with the rocking members 22 being interposed therebetween, the similar actions and effects can be obtained also in this case. However, in view of reduction of the lateral width as much as possible for downsizing of the printer, the structure as described above in this embodiment is preferred.

Figure 14:
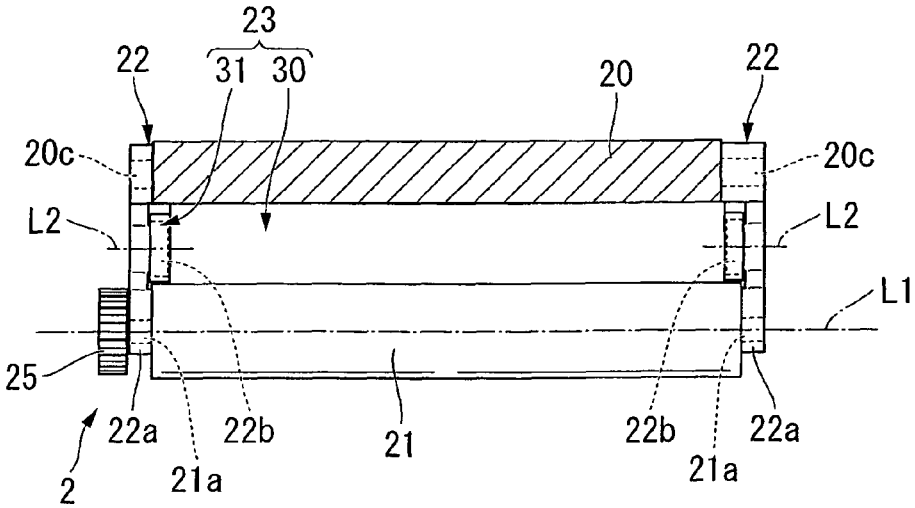
FIG. 14 is a top view of a modification of the platen unit according to the present invention.

Further, as illustrated in FIG. 14, for example, lengths of the rocking members 22 or positions and sizes of the rotary shaft portions 22*b* may be set so that the coupling plates 31 of the latch member 23 are arranged between the platen roller 21 and the platen frame 20. With this, the lateral width of the printer 1 can be further reduced, and hence the printer 1 can be downsized.

What is claimed is:

1. A printer in which a recording head and a platen roller are separably combined with each other, the printer comprising:

a rocking member having a bearing portion for axially supporting the platen roller, the rocking member being mounted to a platen frame so as to be rockable under a state of axially supporting the platen roller;

a latch member coupled to the rocking member under a state of being rotatable about a rotary axis that is non-coaxial with and parallel to a platen axis of the platen roller;

a protrusion provided to the latch member for undergoing rotational movement about the rotary axis in accordance with rotation of the latch member; and a stationary frame to which the recording head is fixed;

wherein the stationary frame comprises:

a first recess into which the bearing portion is disengageably fitted, the first recess retaining the platen roller at a position so as to confront the recording head, and a second recess into which, after the bearing portion is fitted into the first recess, the protrusion is disengageably fitted by the rotation of the latch member;

wherein the bearing portion of the rocking member is not disengageable from inside the first recess while the protrusion is fitted in the second recess, and is disengageable from inside the first recess after the protrusion is disengaged from inside the second recess;

wherein the rocking member comprises a rotary shaft portion projecting along the rotary axis from an inner side surface of the rocking member; and wherein the latch member is rotatably connected to the rotary shaft portion of the rocking member.

2. A printer according to claim 1, further comprising an urging member provided between the platen frame and the latch member for urging the latch member so as to rotate the latch member in a direction in which the protrusion comes close to an inside of the second recess of the stationary frame.

3. A printer according to claim 2, further comprising a regulating member for regulating a rotational amount of the latch member urged by the urging member.

4. A printer according to claim 1, further comprising:

a base member for accommodating a sheet roll formed of a wound recording sheet to be fed between the recording head and the platen roller; and a lid member openably and closably coupled to the base member;

wherein the stationary frame is fixed to the base member; and wherein the platen frame is fixed to the lid member.

5. A printer according to claim 4, wherein the lid member comprises a manipulation lever for rotating the latch member about the rotary axis.

6. A printer comprising:

a stationary frame having a first recess and a second recess;

a platen frame;

a recording head mounted on the stationary frame for recording on a recording medium;

a platen roller mounted for undergoing rotational movement about a platen axis to feed the recording medium;

a rocking member mounted to the platen frame and having a bearing portion and a rotary shaft portion, the bearing portion being configured to be disengageably fitted into the first recess of the stationary frame;

a latch member rotatably connected to the rotary shaft portion of the rocking member under a state of being rotatable about a rotary axis that is non-coaxial with and parallel to the platen axis, the rotary shaft portion of the rocking member projecting along the rotary axis from an inner side surface of the rocking member; and a protrusion integral with the latch member for undergoing movement about the rotary axis in accordance with rotation of the latch member, the protrusion being configured to be disengageably fitted into the second recess of the stationary frame by rotation of the latch member after the bearing portion is fitted in the first recess of the stationary frame.

7. A printer according to claim 6; wherein the bearing portion of the rocking member is not disengageable from inside the first recess while the protrusion is fitted in the second recess, and is disengageable from inside the first recess after the protrusion is disengaged from inside the second recess.

8. A printer according to claim 6; wherein the first recess receives the bearing portion of the rocking member so as to retain the platen roller at a position confronting the recording head.

9. A printer according to claim 6; further comprising an urging member provided between the platen frame and the latch member for urging the latch member so as to rotate the latch member in a direction in which the protrusion comes close to an inside of the second recess of the stationary frame.

10. A printer according to claim 9; further comprising a regulating member for regulating a rotational amount of the latch member urged by the urging member.

11. A printer according to claim 6; further comprising: a base member for accommodating a sheet roll formed of a wound recording sheet to be fed between the recording head and the platen roller, the stationary frame being fixed to the base member; and a lid member openably and closably coupled to the base member, the platen frame being fixed to the lid member.

12. A printer according to claim 11; wherein the lid member comprises a manipulation lever for rotating the latch member about the rotary axis.

13. A printer according to claim 6; wherein the rocking member is mounted to the platen frame so as to be rockable under a state of axially supporting the platen roller.

14. A printer comprising:

a rocking member having a rotary shaft portion and having a bearing portion for axially supporting a platen roller;

a latch member having a protrusion, the latch member being rotatably connected to the rotary shaft portion of the rocking member so as to be rotatable about a rotary axis that is non-coaxial with and parallel to a platen axis, the rotary shaft portion of the rocking member projecting along the rotary axis from an inner side surface of the rocking member; and a stationary frame supporting a recording head, the stationary frame including a first recess into which the bearing portion of the rocking member is disengageably fitted and a second recess into which the protrusion of the latch member is disengageably fitted after the bearing portion is fitted in the first recess.

15. A printer according to claim 14; wherein the bearing portion of the rocking member is not disengageable from inside the first recess while the protrusion is fitted in the second recess, and is disengageable from inside the first recess after the protrusion is disengaged from inside the second recess.

16. A printer according to claim 14; wherein the first recess receives the bearing portion of the rocking member so as to retain the platen roller at a position confronting the recording head.

17. A printer according to claim 14; further comprising an urging member provided between a platen frame and the latch member for urging the latch member so as to rotate the latch member in a direction in which the protrusion comes close to an inside of the second recess of the stationary frame; and a regulating member for regulating a rotational amount of the latch member urged by the urging member.

18. A printer according to claim 14; further comprising a base member for accommodating a sheet roll formed of a wound recording sheet to be fed between the recording head and the platen roller, the stationary frame being fixed to the base member;

and a lid member openably and closably coupled to the base member, the platen frame being fixed to the lid member.

19. A printer according to claim 18; wherein the lid member comprises a manipulation lever for rotating the latch member about the rotary axis.

* * * * *